United States Patent [19]

Philpott et al.

[11] Patent Number: 4,602,265

[45] Date of Patent: Jul. 22, 1986

[54] NON-AQUEOUS COMPOSITIONS FOR HEAT-SENSITIVE MULTI-LAYER COATINGS

[75] Inventors: Arthur K. Philpott, Neerim South; Gordon H. Poole, Mitcham, both of Australia

[73] Assignee: Mark Sensing (Aust.) Pty. Limited, Australia

[21] Appl. No.: 599,000

[22] Filed: Apr. 11, 1984

[30] Foreign Application Priority Data

Apr. 11, 1983 [AU] Australia ..... PF8810/83

[51] Int. Cl.[4] ..... B05D 1/36; B05D 7/00; B41M 3/12; B41M 5/00

[52] U.S. Cl. ..... 346/210; 106/21; 346/202; 346/226; 427/148; 427/411; 524/564

[58] Field of Search ..... 106/21; 346/202, 210, 346/211, 226; 427/148, 411; 524/564

[56] References Cited

U.S. PATENT DOCUMENTS

| | | | |
|---|---|---|---|
| 3,682,684 | 8/1972 | Newman et al. | 427/411 X |
| 4,004,065 | 1/1977 | Matsushita et al. | 427/148 X |
| 4,032,690 | 6/1977 | Kohmura et al. | 428/263 |
| 4,158,648 | 6/1979 | Meadus et al. | 346/211 X |
| 4,251,593 | 2/1981 | Sakamoto et al. | 427/148 X |

FOREIGN PATENT DOCUMENTS

| | | | |
|---|---|---|---|
| 176196 | 10/1982 | Japan | 346/211 |
| 612883 | 8/1979 | Switzerland . | |
| 910475 | 3/1982 | U.S.S.R. . | |

OTHER PUBLICATIONS

Chem. Abstracts, 97, 31296g (1982).

*Primary Examiner*—Michael R. Lusignan
*Attorney, Agent, or Firm*—Merchant, Gould, Smith, Edell, Welter & Schmidt

[57] ABSTRACT

A heat sensitive color-producing multi-layer coating including a first coating layer formed from a base polymeric coating composition comprising a solution of film-forming polymer, a source of polyvalent metallic ions, and at least one fatty acid or derivative thereof; a second coating layer, on the first coating layer, formed from a sensitizing coating composition comprising a solution of organic film-forming polymer, at least one fatty acid or derivative thereof, and reducing agent selected from catechol, pyrogallol, hydroquinone, diphenyl carbazides, gallic acid esters including ethyl gallate, propyl gallate and lauryl gallate, and derivatives thereof; and a third coating layer, on the second coating layer formed from a base polymeric coating composition as defined above.

8 Claims, 4 Drawing Figures

NON-AQUEOUS COMPOSITIONS FOR HEAT-SENSITIVE MULTI-LAYER COATINGS

The present invention relates to an improved system for thermal printing. It is particularly concerned with the treatment of uncoated flexible, relatively porous substrates, and their application is thermal printing with particular reference to totalizator betting tickets.

Particular examples of substates which could find application in the present system include paper, cardboard, paperboard, woven fabrics or the like which in the present context may conveniently be referred to as boardstock.

Whilst heat-sensitive printing materials and machines are known, the heat-sensitive materials of the prior art suffer from significant deficiencies including temperature susceptibility, poor printing clarity and deterioration over time.

Prior to the present invention, substrates for heat sensitive printing have only been available in large rolls, and thus applicable only to large-scale use. These substrates are required to be high quality boardstock and thus lead to a high cost final product. The prior art coated substrates are also extremely costly to produce there being an approximately 4 fold increase in price from the original to the coated substrate.

Furthermore, as only particular areas of the substrate need be coated for any particular application, the coating of the entire substrate surface is both expensive and wasteful. The coating of the entire substrate surface also poses problems where conventional printing is required on part of the substrate as such coatings are generally incompatible with conventional printing inks and techniques.

In referring to a totalizator betting ticket as an example only of the use to which the heat sensitive coated substrates may be put, it is necessary that the ticket have standard information printed thereon. This standard information, for example advertising, statutory warnings, etc. is most appropriately applied by conventional printing techniques prior to the race day application of betting information by the thermal printing unit. As stated above, such standard information cannot conveniently be applied to heat sensitive substrates currently available.

A further difficulty related to the prior art has been the prior art coated substrates have created a high level of wear on the printing machines, in particular on the printing heads. Accordingly, the heads must be replaced regularly which is both costly and produces a high level of machinery downtime.

Accordingly it is an object of the present invention to overcome, or at least alleviate, some of the difficulties related to the prior art.

Accordingly, in accordance with the present invention there is provided a heat sensitive multi-layer coating, a coated substrate, coating compositions for use therewith, and methods and apparatus for preparing and applying the coating to the substrate.

According to a first aspect of the present invention, there is provided a base polymeric coating composition, for use in a heat sensitive color-producing multi-layer coating, which coating composition comprises (a) a solution of an organic film-forming polymer, (b) a source of polyvalent metallic ions, and (c) at least one fatty acid or derivative thereof.

The organic film-forming polymer (a) may be an alcohol soluble synthetic resin. The organic film-forming polymer may be a vinyl polymer or copolymer. A polyvinyl ester alcohol, acetal or derivatives thereof may be used. A polyvinyl butyral polymer or copolymer is preferred.

The organic film-forming polymer may be water-white and light-fast. The organic film forming polymer may have a substantially neutral pH. A preferred polymer is a ketone resin. A ketone-formaldehyde resin may be used e.g. a resin sold under the trade designation "Leuna" L2 resin and available from ICI Australia Ltd. A polyvinyl butyral-cyclic ketone resin may be used, e.g. a resin sold under the trade designation "synthetic resin SK" and available from Chemische Werke Hols of Germany.

The organic film-forming polymer may be present in amounts of from approximately 20 to 30% by weight, preferably approximately 25% by weight based on the total weight of the base polymer coating composition.

The organic film-forming polymer may be used in the form of a solution. An approximately 30% to 50% v/v preferably 40% v/v solution is preferred. The organic film-forming polymer solution may form approximately 40 to 50% by weight based on the total weight of the base polymeric coating composition. As stated above an alcohol-soluble synthetic resin is preferred.

The polyvalent metallic ions which may be present in component (b) of the base polymeric coating composition may be selected from ferric, cupric, ceric, mercuric, stannic, bismuthic, and other polyvalent base metal ions having a standard reduction potential greater than one-tenth of a volt. A preferred metallic ion is ferric ion.

The polyvalent metallic ions may be present as metallic salts. Metallic salts of fatty acids may be used. For example, ferric tristearate is preferred. The metallic salts may be present in amounts of from approximately 10 to 15% by weight based on the total weight of the base polymeric coating composition.

The fatty acid component (c) of the base polymeric coating composition may be selected from stearic, behenic, oleic, or lauric acid or derivatives thereof. Stearic acid is preferred. The fatty acid or derivative thereof may be present in amounts of from approximately 5 to 10% by weight based on the total weight of the base polymeric coating composition.

In a preferred form, the base polymeric coating composition may further comprise (d) an organic solvent.

The organic solvent may be selected from alcohols, aliphatic hydrocarbons, glycol ethers and the like. As stated above an alcohol-soluble film forming polymer is preferred. Accordingly the organic solvent is preferably an alcohol. Methanol and ethanol are particularly preferred.

It is particularly preferred that the organic solvent used is the same as the solvent used in the organic film forming polymer solution. In this form the amount of organic solvent present in the base polymeric coating composition may range from approximately 50 to 55% by weight based on the total weight of the base polymeric coating composition. As stated above, the organic film forming polymer (a) may be present as an approximately 30% to 50% v/v solution in ethanol. Further ethanol may be present in an amount of from approximately 15 to 20% by weight.

In a particularly preferred embodiment of the base polymeric coating composition may further comprise (e) a chelating agent.

The chelating agent may be selected from tartaric acid, citric acid, gluconic acid, ethylenediamine, tetraacetic acid or the like. Tartaric acid is preferred. The chelating agent functions to chelate with any free metallic ions present. The chelating agent may be present in amounts of from 0 to 0.5% by weight, preferably 0.25% by weight based on the total weight of the base polymeric coating composition.

As discussed below the heat sensitive multi-layer coating includes a protective coating layer. Desirably if such a protective coating layer is not included, the first polymeric coating composition may further including (f) a hardening agent.

The hardening agent may be selected from any suitable thickening agent useful in the field of coating compositions. For example the hardening agent may be a silicon dioxide containing thickener. A silicon dioxide type thickener sold under the trade designation Wacker HDKN20 and available from Hoechst Australia Limited has been found to be suitable.

In a preferred form the hardening agent may be present in an amount of from approximately 1 to 5% by weight preferably 2.5% by weight based on the total weight of the protective coating composition.

It is particularly preferred that a hardening agent be included in the first polymeric coating composition when used to form the upper or third coating layer of the multilayer coating described below.

According to a further aspect of the present invention there is provided a method of preparing a base polymeric coating composition which method comprises (a) providing
  (i) a solution of an organic film-forming polymer, and
  (ii) a source of polyvalent metallic ions,
(b) mixing (i) and (ii) together for a period of approximately 15 to 20 hours,
(c) adding at least one fatty acid or derivative thereof to the mixture so formed, and
(d) continuing the mixing for a further period of approximately 10 to 15 hours.

As stated above the organic film-forming polymer may be a vinyl polymer resin. The vinyl polymer resin may be present in the form of an alcohol solution.

The mixing may be undertaken in a lined ball mill. The mixing may continue for a period of approximately 15 to 20 hours after which the fatty acid or derivative thereof may be added. Mixing may then continue for a further period of approximately 10 to 15 hours.

In a preferred form the method of preparing a base polymeric coating composition may further comprise (e) adding a chelating agent to the substantially homogeneous mixture so formed.

The chelating agent may be added just prior to the end of the mixing process. Mixing may then continue for a period of approximately 10 to 20 minutes.

The method of preparing a first polymeric coating composition may further comprise (f) adding a hardening agent to the mixture formed in step (b).

The coating composition so formed may be removed from the ball mill via a washing step utilising the organic solvent, e.g. ethanol.

In a further aspect of the present invention there is provided a sensitising coating composition, for use in a heat-sensitive color-producing multilayer coating, which sensitizing coating composition comprises (a) a solution of an organic film-forming polymer,
(b) at least one fatty acid or derivative thereof, and
(c) a reducing agent selected from catechol, pyrogallol, hydroquinone, diphenyl carbazides, gallic acid esters including ethyl gallate, propyl gallate, and lauryl gallate, and derivatives thereof.

The organic film-forming polymer (a) may be the same as, or similar to, the organic film-forming polymer utilised in the base polymeric coating composition. Preferably the polymers used in each composition are the same.

In the sensitising coating composition the organic film-forming polymer may be present in the form of a solution. An approximately 30 to 50% v/v preferably 40% v/v solution is preferred. The organic film forming polymer may be present in an amount of approximately 30 to 50% by weight based on the total weight of the sensitizing coating composition. The organic film-forming polymer solution may form approximately 95 to 98% by weight based on the total weight of the sensitising composition.

The fatty acid or derivative thereof may be similar to, or the same as, the fatty acid component present in the base polymeric coating composition. The fatty acid or derivative thereof may be present in an amount of from approximately 0.5 to 3% by weight based on the total weight of the sensitizer composition. Stearic acid is particularly preferred as the fatty acid for the sensitising coating composition.

The reducing agent (c) of the sensitising coating composition, as stated above may be selected from catechol, pyrogallol, hydroquinone, diphenyl carbazines, gallic acic esters including ethyl gallate, propyl gallate, and lauryl gallate, and derivatives thereof. Propyl gallate is particularly preferred as the reducing agent.

The reducing agent may be present in the sensitising composition in amounts of from approximately 1.5 to 5% by weight preferably 2.5% by weight based on the total weight of the sensitizing coating composition.

In a preferred form, the sensitising coating composition may further comprise (d) a chelating agent.

The chelating agent may be similar to that used in the base polymeric coating composition. For the sensitising coating composition tartaric acid is preferred.

The chelating agent may be present in an amount of approximately 0% to 0.5% by weight based on the total weight of the sensitising coating composition.

In accordance with a still further aspect of the present invention there is provided a method for preparing a sensitising coating composition for use in a heat sensitive color producing multilayer coating which method comprises (a) providing a solution of an organic film-forming polymer and at least one fatty acid or derivative thereof,
(b) mixing the two components together under high shear for a period of approximately 10 to 20 minutes at elevated temperatures, and
(c) adding a reducing agent to the mixture so formed just prior to the completion of the process.

The mixing of the solution of organic film forming polymer and fatty acid or derivative thereof may continue for approximately 10 to 20 minutes, preferably 15 minutes and may be conducted in a high speed disperser. The mixture may be heated slightly above room temperature, e.g. approximately 40° C. to aid in the formation of the mixture.

In a preferred form the method further comprises preliminary step (a') as a mixing solution of an organic film-forming polymer and a chelating agent under high shear for a period of approximately 5 to 15 minutes.

The mixing of the chelating agent and the organic film-forming polymer solution may continue for a period of approximately 5 to 15 minutes, preferably 10 minutes.

An advantage of the sensitising coating composition is that it may be stored in a plastic vessel, e.g. a polythene vat for a considerable period prior to use.

In accordance with a still further aspect of the present invention there is provided a primer coating composition comprising (a) a solution of an organic film-forming polymer having a substantially neutral pH,
(b) a pigment, and
(c) a filler.

Preferably in accordance with the present invention, there is provided a substrate coated with a primer coating composition as described above. The substrate may be a boardstock as defined above. The primer coating composition assists in providing a smooth, surface of neutral pH on the substrate. Thus lesser quality substrates may be utilised.

The organic film-forming polymer (a) in the primer coating composition may be similar to, or the same as, the film-forming polymer utilised in the base polymeric coating composition and/or the sensitising coating composition. A polyvinyl butyral-cyclic ketone resin such as SK resin described above is preferred. The SK resin may be present in the form of a solution preferably a solution in ethanol. The organic film forming polymer may be present in an amount of from approximately 15 to 20% by weight based on the total weight of the primer coating composition. The organic film-forming polymer solution may comprise approximately 45 to 50% by weight based on the total weight of the primer coating composition.

The pigment (b) of the primer coating composition may be of any suitable type. A white pigment is preferred. Titanium dioxide is particularly preferred. For example, a rutile titanium dioxide such as that having the trade designation ICI RHD2 available from ICI Australia Operations Pty. Ltd. may be used. The pigment may be present in the primer coating composition in an amount of from approximately 25 to 30% by weight based on the total weight of the primer coating composition. The filler (c) may be selected from calcium carbonate, magnesium silicate, barium sulfate, kaolin, bentonite clays, calcium silicate, mica, graphite and the like. Kaolin is preferred. For example, a kaolin sold under the trade designation ECKALITE 2 available from Kaolin Australia Pty. Ltd. has been found to be suitable. This is a paper grade kaolin.

The filler functions to provide the substrate with a relatively smooth surface for the remaining layers of the multi-layer coating. The filler may be present in an amount of from approximately 5 to 10% by weight based on the total weight of the primer coating composition.

In a preferred form the primer coating composition further comprises (d) an organic solvent, and
(e) a chelating agent.

The organic solvent may be similar to, or the same as, that utilised in the base polymeric coating composition. For example, an alcohol e.g. methanol or ethanol may be used. The organic solvent may be the same as that used for the organic film forming polymer.

The organic solvent may be present in an amount of approximately 15 to 20% by weight based on the total weight of the primer coating composition. This is in addition to the amount of organic solvent in the organic film forming polymer solution. The total amount of organic solvent may be from approximately 40 to 50% by weight based on the total weight of the primer coating composition.

The chelating agent (e) may be similar to or the same as that used in the base and primer coating compositions. Tartaric acid is preferred as the chelating agent as it is alcohol soluble. The chelating agent may be present in an amount of approximately 0% to 1% preferably 0.5% based on the total weight of the primer coating composition. The chelating agent in the primer coating composition functions to bind any free ion present in the coating composition or in the substrate.

In accordance with a further aspect of the present invention there is provided a method for preparing a primer coating composition which method comprises (a) providing a solution of an organic film-forming polymer having a substantially neutral pH, a pigment and a filler, and
(b) mixing the components for a period sufficient to produce a substantially homogeneous mixture. The method may further comprise
(c) adding an organic solvent and a chelating agent to the mixture and continuing mixing for a period sufficient to provide a substantially homogeneous mixture, and
(d) removing the substantially homogeneous mixture from the vessel by washing with an organic solvent.

The mixing process may be undertaken in a ball mill e.g. a lined ball mill. The mixing process may continue for approximately 12 hours.

In accordance with another aspect of the present invention there is provided a protective coating composition, for use in a heat-sensitive color-producing multilayer coatings, which composition comprises (a) an emulsion or dispersion of an unsaturated organic film-forming polymer,
(b) a moisture-resistant agent, and
(c) a hardening agent.

The unsaturated organic film-forming polymer may be selected from alcohol soluble or alcohol miscible polymers. The unsaturated organic film-forming polymer may be selected from polystyrene, polyvinyl maleate, polyvinyl chloride, polyvinyl acetate, ethyl cellulose or mixtures thereof, and copolymers thereof with other suitable monomers. A particularly preferred polymer is a vinyl acetate-dibutyl maleate copolymer. For example, the vinyl acetate-dibutyl maleate copolymer emulsion available under the trade designation Wallpol 63/807 or Wallpol 9110 available from A.C. Hatrick Chemicals Pty. Ltd. may be used.

The organic film-forming polymer emulsion may be present in an amount of approximately 25 to 35%, preferably 30%, by weight based on the total weight of the protective coating composition.

The moisture-resistant agent (b) of the protective coating composition may be a waxy material. The moisture-resistant agent may be selected to provide anti-blocking properties as well as moisture resistance. Waxy materials such as polyethylene waxes may be used, micronised polyethylene waxes have been found to be particularly suitable, for example a micronised polyethylene wax sold under the trade designation Ceridust 9615A available from Hoechst Australia Limited may be used. The moisture resistant agent may be present in an amount of approximately 1 to 5% by weight preferably 2.5% by weight based on the total weight of the protective coating composition.

The hardening agent (c) of the protective coating composition may be the same as, or similar to, the hardening agent optionally present in the base polymer coating composition according to the present invention. For example the hardening agent may be a silicon dioxide containing thickener. A silicon dioxide type thickener sold under the trade designation Wacker HDKN20 and available from Hoechst Australia Limited has been found to be suitable.

In a preferred form the hardening agent may be present in an amount of from approximately 1 to 5% by weight preferably 2.5% by weight based on the total weight of the protective coating composition.

In a preferred aspect the protective coating composition further comprises (d) an organic solvent.

The organic solvent may be selected from water, alcohols, aliphatic hydrocarbons, gycol ethers and the like. Alcohols are preferred as the organic solvents. Ethanol and methanol are particularly preferred. The organic solvent may be present in an amount of from approximately 60 to 70% by weight based on the total weight of the protective coating composition.

In a further aspect of the present invention there is provided a method of preparing a protective coating composition which method comprises (a) providing an emulsion or dispersion of an unsaturated organic film-forming polymer, a moisture-resistant agent, and a hardening agent in a reaction vessel, (b) mixing the components for a period sufficient to form a substantially homogeneous mixture, and (c) adding an organic solvent to the mixture throughout the mixing process.

The process may further comprise (d) removing the substantially homogeneous mixture from the reaction vessel by washing out with organic solvent.

The mixing step may continue for approximately 12 hours. Approximately half the organic solvent may be added during mixing. The reaction vessel may be a ball mill. Preferably the reaction vessel is a lined ball mill to avoid contamination with traces of metal from the internal surface of the ball mill.

It will be understood that the protective coating composition according to the present invention functions to render the substrate, in use, moisture resistant and also to provide protection for the printing heads during the printing stages.

According to a still further aspect of the present invention there is provided a heat-sensitive color-producing multi-layer coating including (a) a first coating layer formed from a base polymeric coating composition comprising
  (i) a solution of film-forming polymer,
  (ii) a source of polyvalent metallic ions, and
  (iii) at least one fatty acid or derivative thereof, (b) a second coating layer, on the first coating layer, formed from a sensitising coating composition comprising
  (i) a solution of organic film-forming polymer,
  (ii) at least one fatty acid or derivative thereof, and
  (iii) reducing agent selected from catechol, pyrogallol, hydroquinone, diphenyl carbazides, gallic acid esters including ethyl gallate, propyl gallate and lauryl gallate, and derivatives thereof; and (c) a third coating layer, on the second coating layer formed from a base polymeric coating composition as defined above.

Preferably the heat sensitive color-producing multi-layer coating further comprises (a') a primer coating layer formed from a primer coating composition comprising
  (1) a solution of an organic film forming polymer having a substantially neutral pH,
  (2) a pigment, and
  (3) a filler.

Preferably the multi-layer coating further comprises (d) a protective layer on the third coating layer formed from a protective coating composition comprising
  (i) an emulsion or dispersion of an unsaturated organic film-forming polymer,
  (ii) a moisture resistant agent, and
  (iii) a hardening agent.

In a still further aspect of the present invention there is provided a substrate coated with a heat sensitive color-producing multi-layer coating as described above.

The heat sensitive color-producing multi-layer coating according to the present invention may be such that each layer is separately formed on the substrate and dried prior to the application of a further layer. Accordingly discoloration due to spontaneous chemical reactions is avoided. The multi-layer coatings are such that color is produced via heating to a temperature in the range of from approximately 50° C. to 180° C. Color production occurs due to reaction between the metallic ions and reducing agents present in the multi-layer coatings.

The substrate upon which the multi-layer coating is placed may be selected from paper, cardboard, paperboard, woven fabrics and the like which substrates will be hereinafter referred to collectively as "boardstock". For example a "Scott" tabulating cardstock available from VRG Paper may be utilised.

The multi-layer coating may be provided on the boardstock in an amount of approximately 30 to 50 gram wet weight per square meter of boardstock. Preferably approximately 40 gram wet weight per square meter of boardstock is used. The present invention further provides a method for preparing a heat-sensitive color-producing multi-layer coating on a substrate which process comprises (a) providing a substrate, (b) coating the substrate with a series of coating layers as defined above, and (c) drying the substrate after each coating layer has been applied.

The method may further comprise (b') coating the substrate with a primer coating composition according to the present invention.

The method may further comprise (d) coating the substrate with a protective coating composition according to the present invention and drying the coating so formed.

Preferably the substrate is a boardstock. Preferably the coating layers are applied to selected areas of the substrate only. The drying steps are preferably conducted utilising very warm but not hot air. The air may be at temperatures slightly higher than normally encountered in the coating field, for example, air temperatures may be of the order of from approximately 30° C. to 35° C.

In a still further aspect of the present invention there is provided an in-line apparatus for coating a substrate with a heat sensitive color-producing multi-layer coating including, in combination, (a) a first coating unit adapted to apply a base polymeric coating composition to a substrate;
(b) a second coating unit adapted to apply a sensitising coating composition to the substrate;
(c) a third coating unit adapted to provide a third coating layer to the substrate;
(d) drying means positioned after each coating unit; and
(e) substrate delivery means adapted to deliver substrate, in turn, to each of the coating units.

In a preferred form the apparatus further comprises (a') a primer coating unit adapted to provide a primer coating composition to the substrate, and optionally
(f) a protective coating unit adapted to provide a protective coating composition to the coated substrate.

The coated units may be selected from among conventional printing machines, suitably modified. For example, modified printing machines utilising flexographic letterpress, rotogravure or letterset processes may be used. Desirably, each unit in one installation is of the one type preferably of the rotogravure type. The conventional printing machines may be arranged "in-line" to provide the required coating and drying steps to the substrate.

The coating units may be adapted to apply a coating composition to selected areas of a substrate only.

Each coating unit may include (i) a first coating cylinder, and
(ii) a second coating cylinder adapted to receive the substrate therebetween and to apply a coating layer to selected areas of the substrate only.

Preferably the first coating cylinder (i) is an etched or plate-type cylinder and the second coating cylinder (ii) is an impression cylinder.

In a further preferred aspect the in-line apparatus may further include a turn bar or similar unit. The turn bar functions to turn the substrate over, if desired, for selective coating and/or printing on either side of the substrate.

The substrate delivery means may be any conventional conveyor arrangement utilised in the printing industry. For example the substrate delivery means may comprise a series of rollers.

It will be understood that the substrate e.g. a web of boardstock is passed through a series of printing units which in turn coat the selected areas of the boardstock web with a series of coating layers which are each dried prior to the application of a further coating layer. If desired, the coated boardstock may then be fed to one or more further conventional printing units where the application conventially printing information as required.

In performing the process of the present invention it has been found convenient for the boardstock web to be passed through the various coating units at speeds from approximately 200 to 300 feet per minute. The temperature of the web may be conveniently maintained at from 20° to 80° C. preferably 30° C.

The drying means may be of any suitable type. For example, the heating means may take the form of heated rollers e.g. idler rollers and/or air-bed rollers. In this form the drying means are incorporated within the substrate delivery means.

The invention will now be more fully described with reference to the accompanying drawings. It should be understood that the embodiment of the apparatus according to the present invention described in the accompanying drawing is illustrative only and should not be taken in any way as a restriction on the generality of the invention described above.

Figure 1:
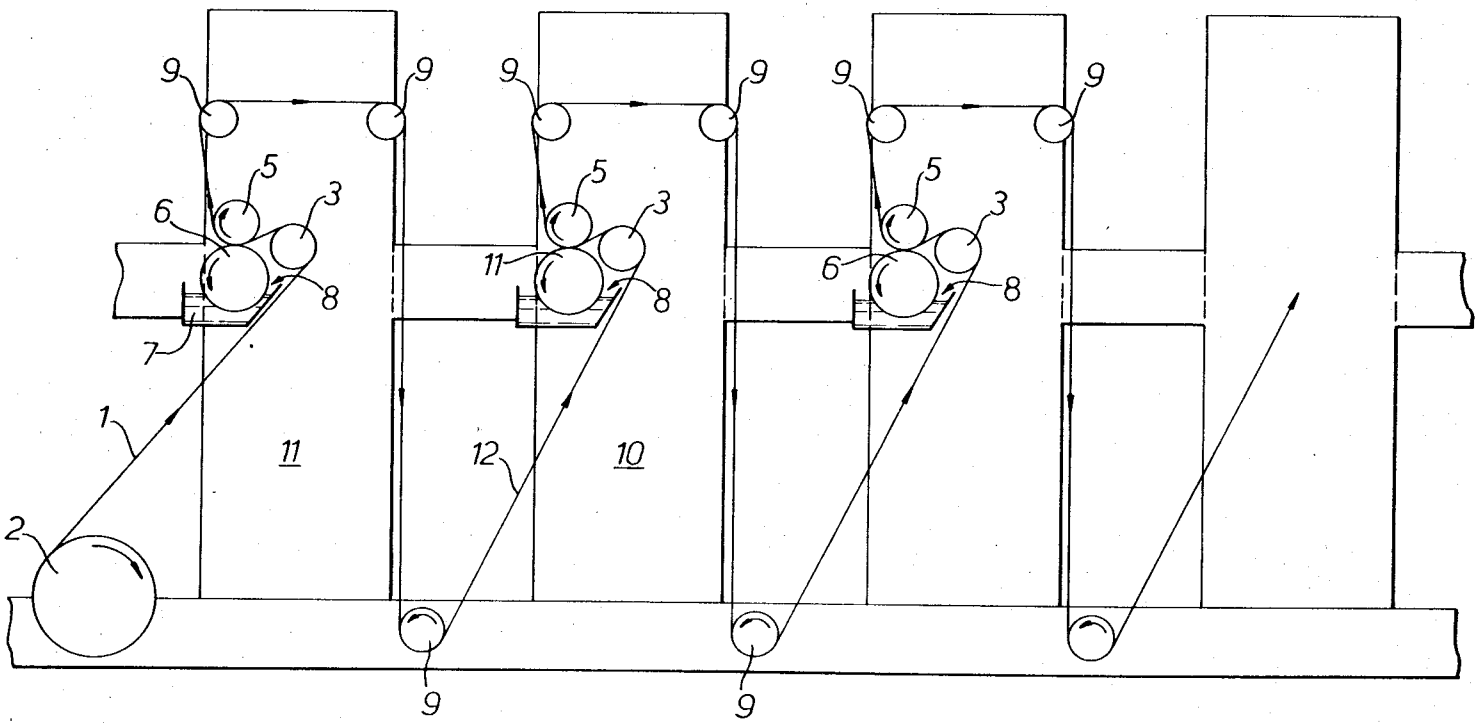
FIG. 1 is a schematic diagram of an apparatus according to the present invention. The apparatus illustrated in FIG. 1 is an adaptation of a rotagravure coating and printing system.

Referring to the embodiment illustrated in FIG. 1 in more detail, a web of boardstock 1 from feed roll 2 is supplied to idler roller 3 of the primer coating unit 4. The web 1 is passed between impression cylinder 5 and etched cylinder 6. Etched cylinder 6 is supplied with the primer coating composition from inking or coating fountain 7. Doctor blades 8 remove excess primer coating material from etched cylinder 6 before application of the coating to the web of boardstock 1. The etched cylinder 6 is provided with an appropriate pattern so that selected areas of the boardstock may be coated.

The selectively primed boardstock is passed via a series of idler rollers 9 to first polymeric coating unit 10. One or more of the idler rollers 9 may be substituted by airbed rollers which are supplied with very warm air to dry the boardstock coated with the primer coating layer prior to entering the first polymeric coating unit 10. It will be understood that the remaining idler rollers are also heated in accordance with standard rotorgravure printing techniques.

Within first polymeric coating unit 10 the coating process described above is repeated with etched cylinder 11 coating the selectively primed areas of the boardstock web 12 with a base polymeric coating layer.

The apparatus illustrated in FIG. 1 may further involve three or more coating units in addition to the primer coating unit and first polymer coating unit described. These will include a sensitising coating unit, a second polymer coating unit, a protective coating unit and optionally a further conventional printing unit or units. Each unit is arranged in line.

Figure 2:
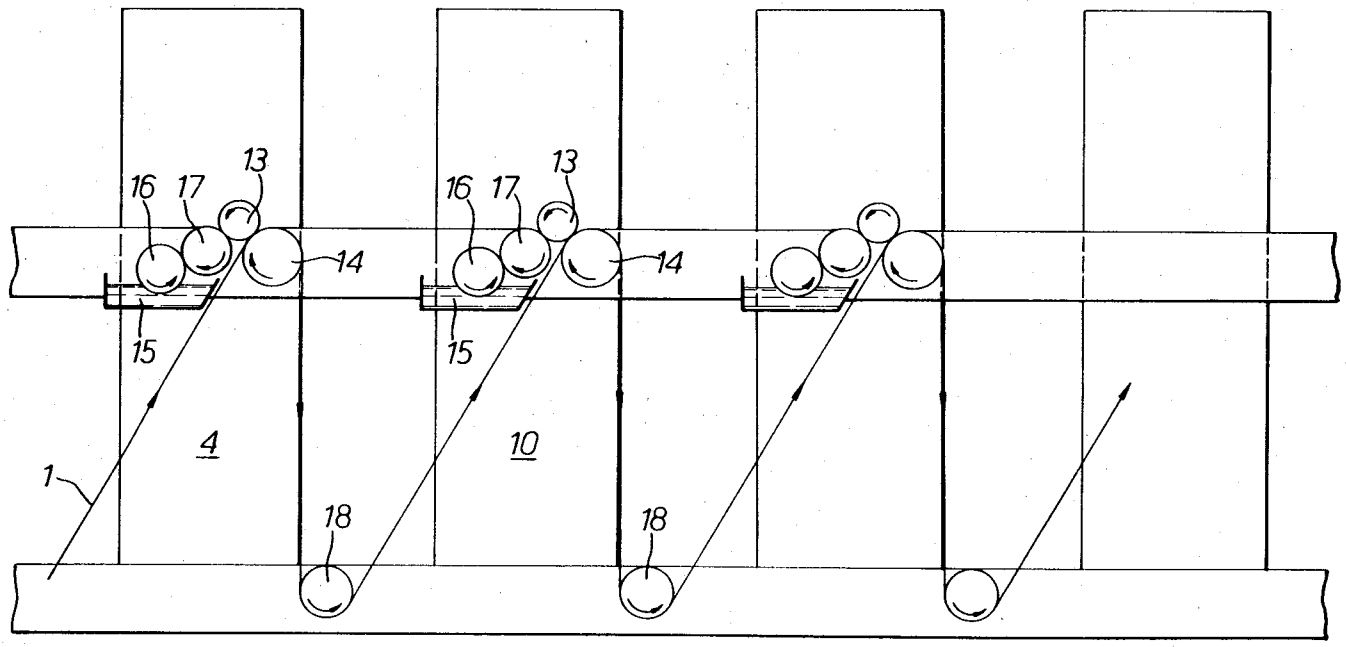
FIG. 2 is a schematic diagram of an apparatus according to the present invention. The apparatus illustrated in FIG. 2 is an adaptation of a flexographic coating and printing system.

Referring to the embodiment illustrated in FIG. 2 in more detail a web of boardstock 1 from a feedroll (not shown) is passed between a plate cylinder 13 and impression cylinder 14. The plate cylinder 13 is supplied with the primer coating composition from the inking or coating fountain 15 via fountain roller 16 and knurled roller 17. It has been found that the substitution of the standard Anilox roller with a knurled roller is advantageous in transferring the polymeric coating composition to the plate cylinder 13.

The plate cylinder 13 may be etched with the appropriate pattern so that selected areas of the boardstock are coated.

The selectively primed boardstock is passed via airbed roller 18 to the first polymeric coating unit 10. The airbed roller 18 ensures that the coated boardstock is heated sufficiently to ensure that the primer coating layer is dry prior to the boardstock entering the first polymeric coating unit 10.

As described above in relation to FIG. 1 the coating process may be repeated in a series of coating units arranged in line to provide the final heat sensitive color producing multi-layer coated boardstock according to the present invention.

Figure 3:
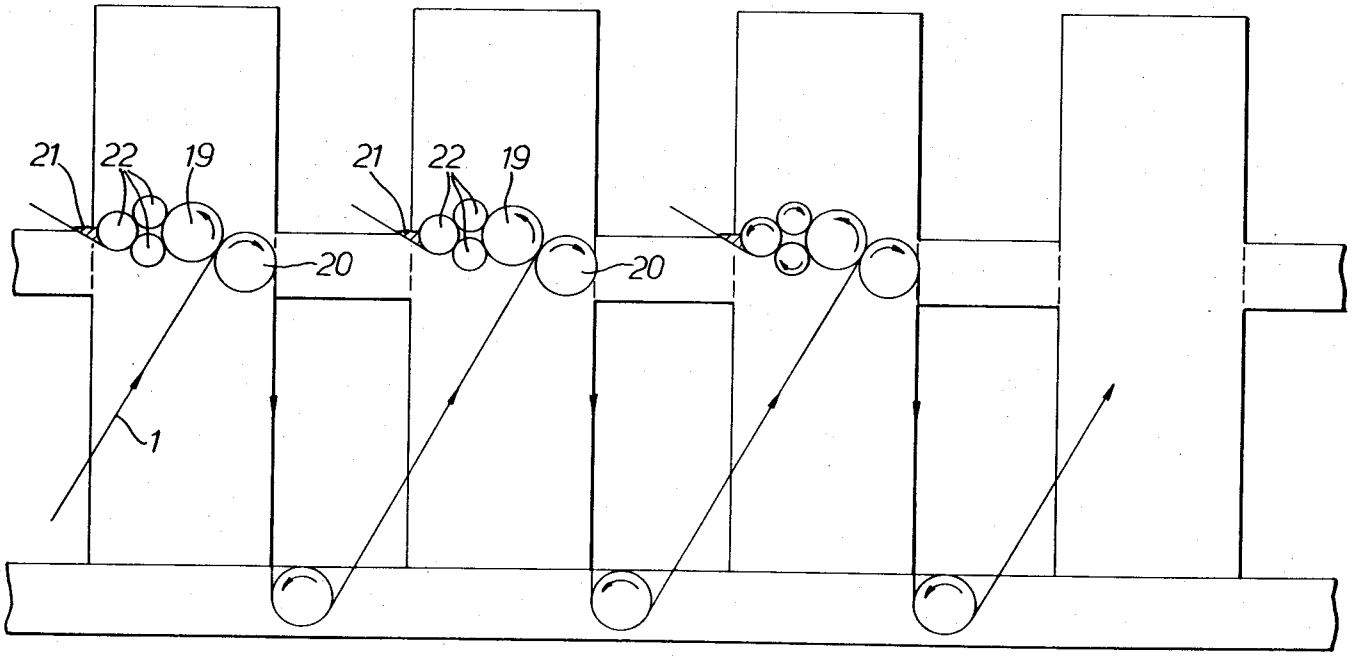
FIG. 3 is a schematic diagram of an apparatus according to the present invention. The apparatus illustrated in FIG. 3 is an adaptation of a letterpress coating and printing system.

Referring to the embodiment illustrated in FIG. 3 in more detail a web of boardstock 1 from a feedroll (not shown) is passed between plate cylinder 19 and impression cylinder 20. The plate cylinder 19 is supplied with the primer coating composition from inking or coating fountain 21 via inking system rollers 22. The remainder of the system is similar to that described above in relation to FIGS. 1 and 2.

Figure 4:
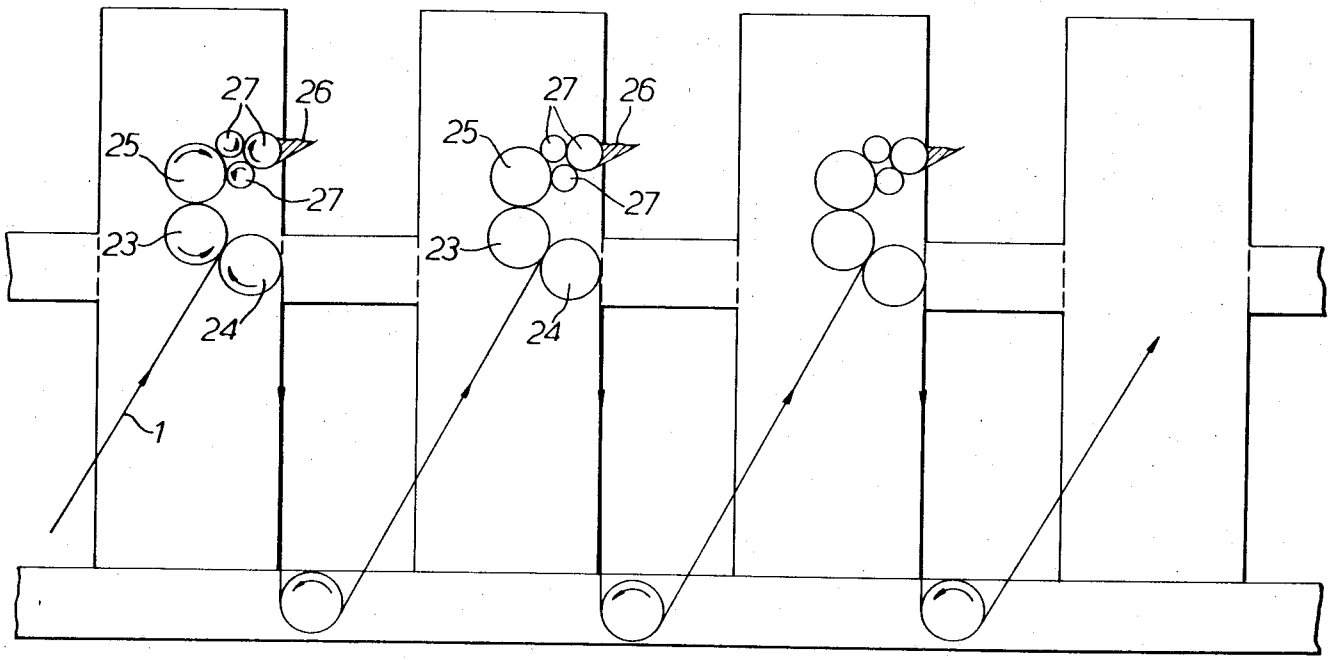
FIG. 4 is a schematic diagram of an apparatus according to the present invention. The apparatus illustrated in FIG. 4 is an adaptation of a letterset coating and printing apparatus.

Referring to the embodiment illustrated in FIG. 4 in more detail, a web of boardstock 1 from a feedroll (not shown) is passed between a blanket cylinder 23 and impression cylinder 24. The blanket cylinder 24 is selectively supplied with the primer coating composition in an appropriate pattern via plate cylinder 25. Plate cylinder 25 is in turn supplied with the primer coating composition from the inking or coating fountain 26 via the inking system of rollers 27.

The remainder of the apparatus illustrated in FIG. 4 is as generally described in relation to FIGS. 1 and 2.

The invention will now be more fully described with reference to the following example. However, the following description is illustrative only and should not be taken in any sense as a restriction on the generality of the invention described above.

EXAMPLE 1

A primer coating composition, a base polymeric coating composition, a sensitising composition and a protective coating composition were prepared according to the following formulations:

| PRIMER COATING COMPOSITIONS | grams |
|---|---|
| 40% Ketone Resin Solution in ethanol | 3000 |
| Tartaric acid | 38 |
| Rutile Titanium dioxide (I.C.I. RHD2) | 1800 |
| Ethanol | 1000 |
| Eckalite 2 (Kaolin) | 535 |
| | 6373 |

The primer coating composition was prepared as follows: 3,000 grams of a 40% Ketone resin solution in ethanol was placed in a ball mill together with tartaric acid, rutile titanium oxide and kaolin and the mixture milled for a period of approximately 12 hours.

After a period of 1 to 2 hours approximately 500 grams of ethanol is added to the mill to assist in the mixing process. At the end of the mixing process when a substantially homogeneous mixture is completed this mixture is removed by washing with the remainder of the ethanol.

| BASE POLYMER COATING COMPOSITION | grams |
|---|---|
| Ferric tristearate | 800 |
| 40% Ketone Resin Solution in ethanol | 3500 |
| Stearic acid | 400 |
| Tartaric acid | 15 |
| Ethanol | 840 |
| | 5555 |

The base polymeric coating composition is prepared as follows: 800 grams of ferric tristearate and 3500 grams of 40% Ketone resin solution in ethanol are milled together in a ball mill for approximately 18 hours.

400 grams of stearic acid are then added and milling is continued for a further 12 hours. 15 grams of tartaric acid is then added and milling continued for approximately 15 minutes. The substantially homogeneous mixture thus formed may be removed by washing out of the ball mill with ethanol.

| SENSITISING COATING COMPOSITION | grams |
|---|---|
| 40% Ketone Resin Solution in ethanol | 4835 |
| Tartaric acid | 10 |
| Stearic acid | 30 |
| Propyl gallate | 125 |
| | 5000 |

The sensitising coating composition is prepared as follows: 4,835 grams of 40% Ketone resin solution in ethanol together with 10 grams of tartaric acid are mixed in a high speed disperser under slight heating for approximately 15 minutes.

30 grams of stearic acid are then added to the dispersion and mixing continued under slight heating for a period of approximately 10 minutes.

125 grams of propyl galeate is then added and the dispersing continued for 1 to 2 minutes.

| PROTECTIVE COATING COMPOSITION | grams |
|---|---|
| Wallpol 63-807 | 2000 |
| Ethanol | 4000 |
| Ceridust 9615 A | 150 |
| Wacker HDK N20 | 150 |
| | 6300 |

The protective coating composition was prepared as follows: 2000 grams of a vinyl acetate dibutyl maleate copolymer emulsion (Wallpol 63-807) was placed in a lined ball mill together with 150 grams of a micronised polyethylene wax (ceri dust) and 150 grams of a silicon dioxide thickener (Wacker HKDN20) and the mixture milled for a period of approximately 12 hours.

After a period of 1 to 2 hours, approximately 2000 grams of ethanol are added to the mill to assist in the mixing and process. At the end of the mixing process when a substantially homogeneous mixture is produced, this mixture is removed by washing with the remainder of the ethanol.

Finally, it is to be understood that various other modifications and/or alterations may be made without departing from the spirit of the present invention as outlined herein.

We claim:

1. A substrate coated with a heat sensitive color-producing multilayer coating comprising:
(a) a base coating layer formed from a non-aqueous, quick drying base polymeric coating composition consisting essentially of:
(i) an alcohol solution of an organic film-forming polymer,
(ii) a source of polyvalent metallic ions, having a standard reduction potential greater than one-tenth of a volt,
(iii) at least one fatty acid or non-metallic derivative thereof, and
(iv) an alcohol,
(b) a second coating layer, on the base coating layer, formed from a non-aqueous, quick drying sensitizing coating composition consisting essentially of:
(i) an alcohol solution of organic film-forming polymer,
(ii) at least one fatty acid or non-metallic derivative thereof, and
(iii) at least one reducing agent selected from the group consisting of catechol, pyrogallol, hydroquinone, diphenyl carbazides, gallic acid esters and derivatives thereof; and
(c) a third coating layer, on the second coating layer, formed from the base polymeric coating composition as set forth in step (a).

2. The coated substrate of claim 1 wherein the multilayer coating further comprises a primer coating layer formed from a non-aqueous, quick drying primer coating composition comprising:
(a) an organic solution of an organic film-forming polymer having a substantially neutral pH,
(b) a pigment,
(c) a filler, and
(d) an alcohol, wherein said primer coating layer is applied to said substrate prior to the base coating layer.

3. The coated substrate of claim 2 wherein the multilayer coating comprises a protective layer on the third coating layer formed from a non-aqueous, quick drying protective coating composition comprising:
(a) an emulsion or dispersion of an unsaturated organic film-forming polymer,
(b) a moisture resistant agent,
(c) a hardening agent, and
(d) an alcohol.

4. The coated substrate of claim 3, wherein the substrate is a boardstock.

5. A substrate coated with a heat-sensitive color-producting multi-layer coating comprising:
(a) a primer coating layer formed from a non-aqueous, quick drying primer coating composition comprising:
(i) about 45 to 50% by weight of an ethanol solution of ketone resin,
(ii) about 25 to 30% by weight of a titanium oxide pigment,
(iii) about 5 to 10% by weight of a kaolin filler, and
(iv) about 10 to 25% by weight of ethanol,
(b) a base coating layer, on said primer coating, formed from a non-aqueous, quick drying base polymeric coating composition consisting essentially of:
(i) about 40 to 50% by weight of ethanol solution of a ketone resin,
(ii) about 10 to 15% by weight of ferric tristearate,
(iii) about 5 to 10% by weight of stearic acid, and
(iv) about 15 to 45% by weight of ethanol,
(c) a second coating layer formed from a non-aqueous, quick drying sensitizing coating composition consisting essentially of:
(i) about 95 to 98% by weight of an ethanol solution of a ketone resin,
(ii) about 0.5 to 3% by weight of stearic acid,
(iii) about 1.5 to 5% by weight of a gallic acid ester selected from the group consisting of ethyl gallate, propyl gallate and lauryl gallate,
(d) a third coating layer formed from the base coating composition as set forth in step (b),
(e) a protective coating layer formed from a non-aqueous, quick drying protective coating composition comprising:
(i) about 25 to 35% by weight of an emulsion of a vinyl acetate-dibutyl maleate copolymer in ethanol,
(ii) about 1 to 5% by weight of a polyethylene wax, and
(iii) about 1 to 5% of a silicon dioxide thickener.

6. A method for preparing a heat sensitive color producing multi-layer coating on a substrate which comprises:
(a) providing a substrate,
(b) coating the substrate in turn with the coating layers as set forth in steps (a)–(c) of claim 1, and
(c) drying the substrate after each coating layer has been applied.

7. The method of claim 6 wherein the substrate is a boardstock.

8. The method of claim 7 wherein the coating layers are applied to selected areas of the boardstock only.

* * * * *